US008651020B2

(12) United States Patent
Schnabel et al.

(10) Patent No.: US 8,651,020 B2
(45) Date of Patent: Feb. 18, 2014

(54) METHOD FOR WEB TENSION ADJUSTMENT

(75) Inventors: Holger Schnabel, Rottendorf (DE); Stephan Schultze, Lohr-Wombach (DE); Mario Goeb, Wuerzburg (DE)

(73) Assignee: Robert Bosch GmbH, Stuttgart (DE)

( * ) Notice: Subject to any disclaimer, the term of this patent is extended or adjusted under 35 U.S.C. 154(b) by 568 days.

(21) Appl. No.: 12/753,412

(22) Filed: Apr. 2, 2010

(65) Prior Publication Data

US 2010/0269720 A1 Oct. 28, 2010

(30) Foreign Application Priority Data

Apr. 3, 2009 (DE) ..... 10 2009 016 206

(51) Int. Cl.
*B41F 13/02* (2006.01)
*B65H 23/04* (2006.01)

(52) U.S. Cl.
USPC .... 101/228; 101/232; 101/484; 101/DIG. 42; 242/419.5; 226/2; 226/28

(58) Field of Classification Search
USPC ..... 101/484
See application file for complete search history.

(56) References Cited

U.S. PATENT DOCUMENTS

| | | | | |
|---|---|---|---|---|
| 3,806,012 | A * | 4/1974 | Roch | 101/484 |
| 6,092,466 | A * | 7/2000 | Koch et al. | 101/485 |
| 6,810,812 | B2 * | 11/2004 | Fischer | 101/228 |
| 7,137,338 | B2 * | 11/2006 | Brandenburg et al. | 101/484 |
| 7,204,189 | B2 * | 4/2007 | Brandenburg et al. | 101/485 |
| 2005/0137738 | A1 * | 6/2005 | Carlson et al. | 226/24 |
| 2007/0131036 | A1 * | 6/2007 | Schultze | 242/410 |
| 2008/0250962 | A1 * | 10/2008 | Schnabel et al. | 101/486 |
| 2009/0293746 | A1 * | 12/2009 | Schultze et al. | 101/248 |

* cited by examiner

*Primary Examiner* — Jill Culler
(74) *Attorney, Agent, or Firm* — Maginot, Moore & Beck

(57) ABSTRACT

The invention relates to methods for web tension adjustment in a processing machine for processing a web of goods, in particular in a shaftless printing press, in which downstream web tension segments are decoupled from an adjustment of the web tension in a first web tension segment defined upstream by a first clamping point and downstream by a second clamping point. To that end, the first clamping point is subjected to a first control instruction, which is generated using a first dynamic element with a non-constant transmission function, and the second clamping point is acted upon by a second control instruction, which is generated using a second dynamic element with a non-constant transmission function. As a result of the provisions of the invention, for decoupling the downstream web tension segments from the web tension adjustment and so forth, it is unnecessary to pilot-control the corresponding downstream clamping points.

18 Claims, 2 Drawing Sheets

METHOD FOR WEB TENSION ADJUSTMENT

CROSS-REFERENCE TO RELATED APPLICATION

This application is based on German Patent Application 10 2009 016 206.2 filed Apr. 3, 2009.

BACKGROUND OF THE INVENTION

1. Field of the Invention

The present invention relates to a method for web tension adjustment in a processing machine, to a processing machine, to a corresponding computer program, and to a corresponding computer program product.

Although reference will made hereinafter primarily to printing presses, the invention is not limited to them, but instead is directed to all types of processing machines in which a web of goods or web of material is processed. The invention is especially usable, however, in printing presses, such as newspaper printing presses, job printing presses, intaglio presses, inline flexographic printing presses, packaging printing presses, or securities printing presses as well as in processing machines such as bag-making machines, envelope-making machines, or packaging machines. The web of goods may be of paper, fabric, cardboard, plastic, metal, rubber, or in the form of foil or film, and so forth.

2. Description of the Prior Art

In processing machines, especially printing presses, a web of goods is moved along by driven shafts (web transport shafts), such as tension rollers or feed rollers, and nondriven shafts, such as deflection rollers, control rollers, and drying or cooling rollers. Simultaneously, by means of usually driven processing shafts, the web of goods is processed, for instance being imprinted, stamped, cut, folded, and so forth.

The web tension of the web of goods is varied for instance via so-called clamping points, which clamp the web of goods by positive or nonpositive engagement. Typically, this involves transporting or processing mechanisms that are driven. In an intaglio press, a clamping point is typically formed by a printing unit, in which a frictional-engagement unit is between the driven impression cylinder, the presser, and the web of material. The web of goods is subdivided into web tension segments, and one web tension segment is defined by two clamping points. Within one web tension segment, further driven and/or nondriven shafts may be disposed. Often, the entire web of goods is subdivided into a plurality of web tension segments, including those with different set-point web tension values. For maintaining the set-point values, a web tension controller is typically employed.

The adjustment or regulation of the web tension of a web tension segment can be done by various methods. The word "downstream" means that the clamping point that defines the web tension segment downstream is adjusted, while "upstream" means that the clamping point defining the web tension segment upstream is adjusted. However, in this simple embodiment, the web tension in subsequent web tension segments is not decoupled from the control motion. Instead, the change in web tension along the course of the web of goods is transported through the machine and has to be compensated for in all the subsequent segments.

In downstream regulation by means of a (dynamic) downstream pilot control, it is possible to pilot-control all the slave clamping points such that they directly compensate for the effects of the master clamping point. It is consequently ensured that all the following web tension controllers need not compensate for the disruptions of coupling by the web of material.

In German Patent Disclosure DE 10 2008 056 132, which was not published prior to the filing date of the present application, decoupling for an upstream controller is proposed, in which in addition to a (constant) upstream pilot control, a (dynamic) downstream pilot control is also performed by means of a PT1 element.

All the known decoupling strategies have the disadvantage that slave clamping points have to be pilot-controlled. If now for mechanical, structural or other kinds of prerequisites (such as a constant delivery speed) it is impossible to include the slave clamping points in the closed-loop control circuit, then in both regulating strategies the pilot controls required for the decoupling cannot be employed. Moreover, especially in large systems, it is undesirable, after an adjustment at a master clamping point, to adjust all the slave clamping points as well.

OBJECT AND SUMMARY OF THE INVENTION

It is thus the object of the invention to disclose a method for web tension adjustment in a processing machine in which not all the slave clamping points have to be adjusted for the decoupling.

This object is attained by a method for web tension adjustment, a processing machine, a computer program, and a computer program product. Advantageous refinements are the subject of the ensuing description.

In the method according to the invention for web tension adjustment in a processing machine for processing a web of goods, in particular in a shaftless printing press, downstream web tension segments are decoupled from an adjustment of the web tension in a first web tension segment, which is defined upstream by a first clamping point and downstream by a second clamping point. To that end, to adjust the web tension, the first clamping point is acted on by a first control instruction, which is generated using a first dynamic element with a non-constant transmission function. The second clamping point is also acted upon a second control instruction, which is generated using a second dynamic element with a non-constant transmission function. It is understood that the term "control instruction" means in particular a controller output variable or a correcting variable.

The invention includes in particular the teaching that during the adjustment of a web tension, in order to decouple this adjustment, both clamping points defining the applicable web tension segment, can be adjusted dynamically in a defined way. One control instruction then—depending on the regulating strategy selected, that is, upstream or downstream—depends in a predetermined way on the other.

With the provisions according to the invention, a web tension adjustment or regulation can be furnished that by combining dynamic or in other words time-dependent control instructions is flexibly adaptable to the given conditions of the basic machine. In particular, web tension segments can be varied in decoupled fashion without having to adjust all the slave clamping points. In the prior art, no regulating strategies are known that would enable decoupling the web tension adjustment without adjustment of the slave clamping points. The controller layout can be done with more-dynamic closed-loop control circuits, since the number of clamping points to be adjusted drops drastically.

Advantageously, a web tension regulation is performed. For one skilled in the art, it is understood that the adjustment according to the invention can be employed as part of a regulating operation.

The invention, in both an upstream and a downstream strategy, teaches the dynamic adjustment of both clamping points that define the applicable web tension segment. In the prior art, conversely, in an upstream regulating strategy it is usual to adjust the first clamping point statically and not to adjust the second clamping point. In a downstream regulating strategy, it is usual not to adjust the first clamping point, and to adjust the second clamping point statically.

As noted further above, in the upstream strategy it is the first clamping point and in the downstream strategy it is the second clamping point that is adjusted as the master clamping point. In other words, in the upstream strategy, the web tension controller output variable is sent as a correcting variable to the first clamping point via a dynamic element, in particular a DT1 element with positive gain, and the same controller output variable is sent as a control instruction to the second clamping point via a second dynamic element, in particular a PT1 element with negative gain. In a downstream strategy, a controller output variable is predetermined for the second clamping point and is sent via a dynamic element, in particular a PT1 element with positive gain, as a control instruction to the second clamping point, and the same controller output variable is sent as a correcting variable to the second clamping point via another dynamic element, preferably a DT1 element with negative gain.

The terms "upstream" and "downstream" of a processing device or segment of a web of goods refer to the direction in which the web of goods is transported, in other words, the course of the web of goods.

A dynamic element has a non-constant transmission function. A non-constant transmission function is any transmission function that does not have the form G(s)=k, but instead displays a dependency on s. For instance, a D, I, PI, PID, PT1, DT1, PTn, DTn, idle-time circuit each has a non-constant transmission function, while conversely, a P number has a constant transmission function. In this patent application, elements with a non-constant transmission function are called dynamic elements, while elements with a constant transmission function are called static elements.

A processing machine according to the invention in particular has all the mechanisms for performing a method according to the invention.

Preferably, a non-constant transmission function includes the transmission function of a differential element, in particular with delay, in particular a DT1 element, or a proportional element, in particular with delay, in particular a PT1 element. It is understood that still other DTn or PTn elements can be considered, and one skilled in the art will adapt the selection to the particular model of machine that is the basis. The distance between two printing units is approximated as a rule with PT1 behavior, on the basis of the dominant distance time constant, which is calculated from the quotient of the length l of the web of material between the printing units and the speed v of the web of material. If the distance is approximated as PT2, PT3, PTn, then the corresponding decoupling structure can also be employed without departing from the scope of the invention. For instance, in a PTn element, instead of a PT1 element, action can be exerted on the downstream clamping point with a PTn element as well instead of a PT1 element, and action on the upstream clamping point can be exerted with a (1-PTn) element instead of a DT1 element.

In an embodiment that is especially suitable for a downstream strategy, the first control instruction is generated, using the first dynamic element, from the second control instruction or from the controller output variable on which the second control instruction is based. Thus the first, upstream clamping point is pilot-controlled, in order to decouple the downstream web tension segments from the web tension adjustment to be performed.

Expediently—in particular in a downstream strategy—at least one third clamping point, located upstream in the course of the web of goods from the first clamping point, is acted upon by a third control instruction, which is generated, using a third dynamic element with a non-constant transmission function, in particular a DT1 element with negative gain, from the second control instruction. This pilot control advantageously serves to decouple the downstream web tension segments as well from the web tension adjustment that is to be performed.

In a further feature, which is suitable particularly for an upstream strategy, the second control instruction is generated using the second dynamic element from the first control instruction or from the controller output variable on which the first control instruction is based. This pilot control serves in particular to decouple the downstream web tension segments.

Advantageously, in an upstream strategy as well for decoupling the upstream web tension segments, at least one third clamping point, located upstream in the course of the web of goods from the first clamping point, is acted upon by a third control instruction, which is generated using a third dynamic element with a non-constant transmission function, in particular a DT1 element with positive gain, from the second control instruction or from the controller output variable on which the second control instruction is based.

Advantageously, all the clamping points disposed in the course of the web tension upstream of the first clamping point are pilot-controlled as a function of the first control instruction (upstream regulation) or second control instruction (downstream regulation), or in other words are acted upon by one third control instruction each. Optionally, clamping points not embodied as processing devices, such as a feed mechanism, an unwinder, and so forth, can also be pilot-controlled.

The upstream pilot control is expediently performed only as far as the last web tension segment that was affected by the web tension adjustment. In printing presses, for instance, different assemblies, such as cooling or drying devices, are known that in certain cases, because of the influence on the material, perform decoupling of the web tension, so that a change in web tension is not always propagated beyond these assemblies. Web tension segments with such assemblies are in these cases called "self-compensating" or "decoupling". In an expedient feature, thus only the upstream clamping points of non-self-compensating web tension segments are pilot-controlled. In other words, the pilot control is effected preferentially beginning at the affected web tension segment upstream as far as the next self-compensating web tension segment in each case. The manner and intensity of pilot control is suitably adapted to the manner and intensity of the decoupling.

The parameters of the dynamic coupling, in particular the time constants, are preferably adapted in proportion to the inverse of the machine speed v. In addition, it is expedient to adapt the parameters of the dynamic coupling to the length l of the web of goods. The parameters of the dynamic coupling can in particular be adapted in proportion to the web of goods length and/or width. The parameters of the coupling can also be adapted to the type of material to be imprinted (modulus of elasticity). Adapting the parameters and timing circuits can be done by means of fuzzy techniques, model-based techniques, such as model follow up regulation, observer techniques, or Kalman techniques. Advantageously, the web of goods lengths involved in the regulated parameters is calculated in estimated or model-based fashion. The dimensions of the processing machine, such as the circumferences of the rollers, spacings of the rollers, etc., and the positioning of the processing devices (such as angular positioning) are known or at least can be determined, so that from them, the length of the individual segments of the web of goods can be determined.

Independent or automatic adaptation of dynamic timing circuits can advantageously be done, in particular to the web speed and/or the lengths. For that reason, in a feature of the invention, it is appropriate to measure the web speed and/or the lengths between printing units automatically and to adapt the corresponding time constants of the timing circuits, so that the dynamic timing circuits are not made incorrect by variations in speed and/or length. Thus the possibility is obtained, among others, that an independent speed and/or length adaptation and as a result an independent adaptation of the dynamic timing circuits is performed.

In a preferred feature, the web tension in the web tension segments is ascertained by means of metering elements, preferably pressure gauges, by means of the driving torque of at least one clamping point defining that web tension segment, and/or by means of observers.

Expediently, the web tension in a web tension segment is adjusted by means of angular adjustment, speed imposition, and/or limitation of the driving torque of at least one clamping point defining that web tension segment.

Expediently, the decoupling strategy is derived from the addition, subtraction, multiplication, and/or division of dynamic and/or constant timing circuits. As a consequence, all the decoupling strategies arising from combination with further dynamic or constant timing circuits are also the subject of the invention. For instance, PI controllers can be expanded for instance with PT1 or DT1 elements, and as a result still other, to some extent also constant, pilot controls result. For instance, if a controller is provided with an additional DT1 element that includes the distance time constants, then the upstream regulation, explained hereinafter in conjunction with FIG. 2, varies from [DT1, DT1, . . . –PT1, 0, 0, . . . ] to [P, P, –I, 0, 0, . . . ].

A digital unit according to the invention, such as a control unit of a printing press, is arranged, in particular by programming, for performing a method according to the invention.

The invention furthermore relates to a computer program with program code means, for performing all the steps of a method according to the invention, when the computer program is executed on a computer or a corresponding digital unit, for instance on a control unit of a printing press. Implementing the method in the form of software makes especially low costs possible, particularly if an executing control unit is used for other tasks as well and is therefore present anyway.

The computer program product provided according to the invention, with program code means that are stored on a computer-readable data medium, is embodied for performing all the steps in accordance with a method of the invention, when the computer program is executed on a computer or a suitable digital unit. Suitable data media are in particular diskettes, hard disks, flash drives, EEPROMs, CD-ROMS, DVDs, and many more. Downloading a program via computer networks (Internet, intranet, etc.) is also possible.

Further advantages and features of the invention will become apparent from the description and the accompanying drawings.

It is understood that the characteristics described above and to be explained in further detail below can be used not only in the various combinations indicated but in other combinations as well or on their own, without departing from the scope of the present invention.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
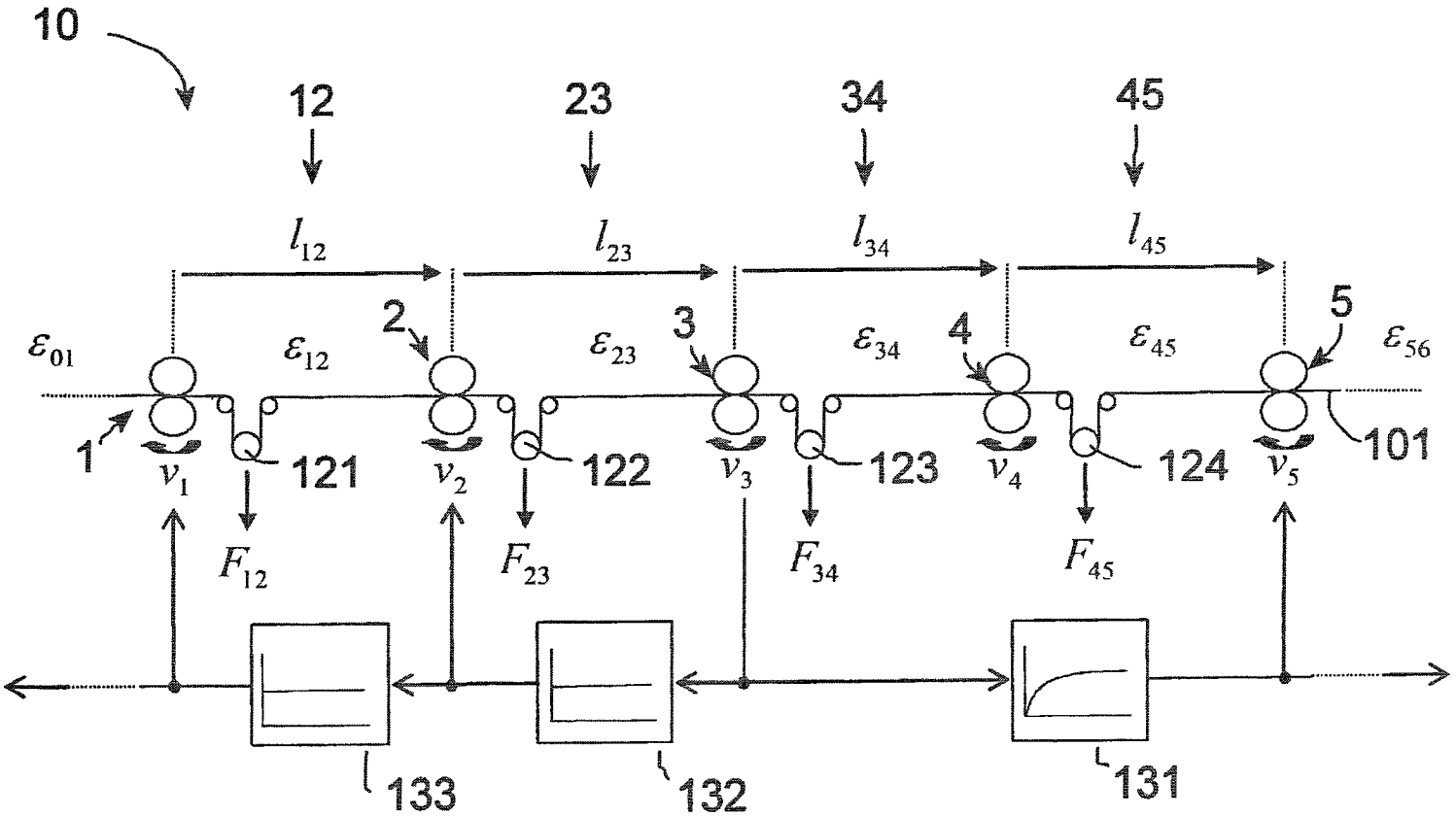
FIG. 1 schematically shows one example for a decoupled upstream strategy in the event of a deviation in web tension in a web tension segment.

In FIG. 1, an upstream regulating strategy is described, taking as an example regulating the web tension in a printing press. A schematic detail of a printing press 10 is shown, in which a web of material 101 is transported and processed by means of five clamping points, embodied here as printing units 1 through 5. Between each two adjacent clamping points, one web tension segment is embodied. For instance, one web tension segment 12 is defined by the printing units 1 and 2; one web tension segment 23 is defined by the printing units 2 and 3; one web tension segment 34 is defined by the printing units 3 and 4; and one web tension segment 45 is defined by the printing units 4 and 5.

The printing press furthermore has web tension sensors, embodied here as pressure gauges 121 through 124, for ascertaining the web tension or the tensile force in the respective web tension segments. In the view shown, the web tension is adjusted via the circumferential speeds $v_1$ through $v_5$ of the printing units 1 through 5.

The physical parameters, namely the length l, the elongation $\epsilon$ and the web tension or tensile force F of the individual web tension segments are also shown in the drawings.

For adjusting the web tension in the web tension segment 34, in the upstream strategy shown, the printing units 1 through 3 are adjusted, and as a result the web tensions in the web tension segments 12 and 23 can be decoupled from the change in the web tension segment 34. The upstream pilot control of the printing units 1 and 2 is done statically, each via a respective proportional element 132, 133 with the proportional gain $K_P=1$.

For decoupling the web tension in the web tension segment 45 from a change in the web tension segment 34, a dynamic pilot control of the printing unit 5 is performed. The dynamic pilot control is effected for instance via a PT1 element 131, and a proportional gain $K_P=1$ and a time constant $T=1_{34}/v$ are selected; v stands for the web speed. If the printing unit 5 includes further clamping points (not shown in the drawings), then the pilot control is continued downstream as far as the next self-compensating or decoupling web tension segment. The pilot control of the further clamping points is likewise effected dynamically via PT1 elements having the same parameters $K_P=1$ and $T=1_{34}/v$. Because of the pilot control of all the downstream clamping points, this method is relatively complicated.

Figure 2:
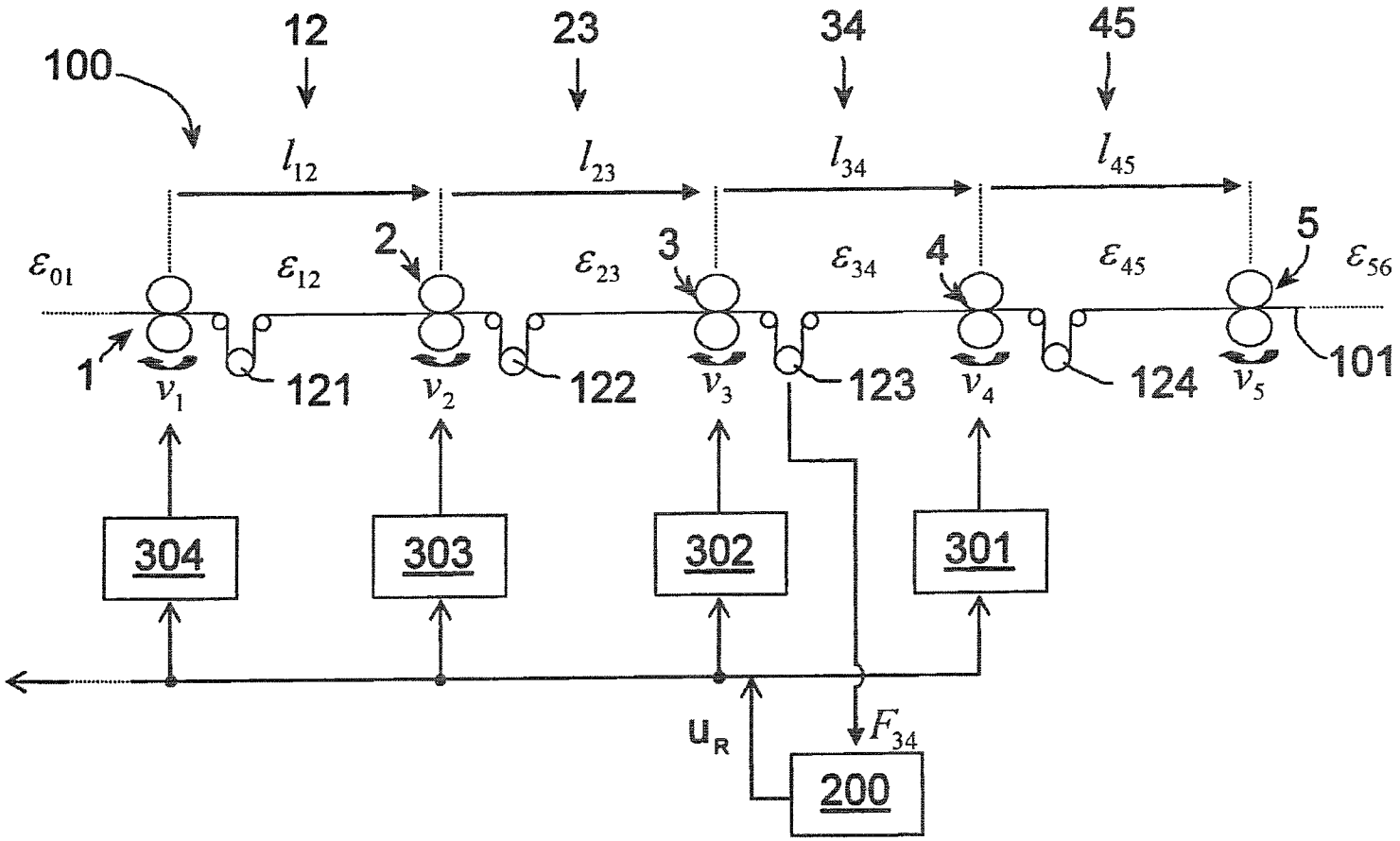
FIG. 2 schematically shows one example for a regulating strategy of the invention in the event of a deviation in web tension in a web tension segment.

In terms of FIG. 2, it will now be explained how by the provisions of the invention decoupling of the downstream web tension segments can be attained without having to pilot control them. In this description, the same elements are identified by the same reference numerals as before.

A printing press 100 is shown, which is regulated in accordance with the exemplary embodiment. The regulating strategy shown can be based on both an upstream and a downstream regulation. The difference in the two kinds of regulation is expressed, in the embodiment of the invention shown, only in the parameters of the dynamic elements (301-304).

The web tension or tensile force $F_{34}$ in the web tension segment 34 is supplied as an actual value to a web tension controller, or to a digital unit 200 that physically embodies it. On the basis of its selected controller type and its controller parameters, the digital unit 200 determines a controller output variable $u_R$. Depending on the basic regulating strategy, the controller output variable $u_R$ is determined for the clamping point at printing unit 3 (upstream strategy) or the clamping point at printing unit 4 (downstream strategy).

First, the embodiment of the invention in an upstream strategy will be described. The controller output variable $u_R$ that is determined for the clamping point at printing unit 3 is delivered to the clamping point at printing unit 3 as a correcting variable, for adjusting the rotary speed $v_3$, for instance, via a dynamic element 302, which is embodied here as a DT1 element with a gain of $K_D=1$ and a time constant $T=1_{34}/v$. For decoupling the downstream web tension segments 45 etc. from the web tension adjustment in the web tension segment 34, the controller output variable $u_R$ is delivered via a second dynamic element 301 to the clamping point at printing unit 4 as a correcting variable for adjusting the speed $v_4$. The second dynamic element 301 is embodied here as a PT1 element with a gain of $K_P=-1$ and a time constant $T=1_{34}/v$. For decoupling the upstream web tension segments 12, 23, and so forth, the controller output variable $u_R$ is delivered, in each case as a correcting variable, to the clamping point at printing unit 2 via a third dynamic element 303 and to the clamping point at printing unit 1 via a fourth dynamic element 304. Expediently, corresponding pilot control is done for all the upstream clamping points, in particular including unwinders and feed mechanisms. The dynamic elements 303 and 304 are expediently also embodied as DT1 elements ($K_D=1$, $T=1_{34}/v$).

A downstream strategy differs from the upstream strategy just now described essentially only in the embodiment of the dynamic elements 301 and 302. In the downstream strategy, the controller output variable up is determined for the clamping point at printing unit 4 and is delivered to it in turn via the dynamic element 301 as a correcting variable for adjusting the speed $v_4$; here, the dynamic element 301 is embodied a PT1 element with positive gain $K_P=1$ and a time constant $T=1_{34}/v$. The controller output variable $u_R$ that is determined for the clamping point 4 is again delivered as a correcting variable for adjusting the rotary speed $v_3$, for instance, to the clamping point at printing unit 3, via the dynamic element 302, which is embodied here as a DT1 element with negative gain $K_D=-1$ and a time constant $T=1_{34}/v$. For decoupling the upstream web tension segments 12, 23, and so forth, the controller output variable $u_R$ is delivered, in each case as a correcting variable, to the clamping point at printing unit 2 via a third dynamic element 303 and to the clamping point at printing unit 1 via a fourth dynamic element 304. Expediently, corresponding pilot control is done for all the upstream clamping points, in particular including unwinders and feed mechanisms. The dynamic elements 303 and 304 are expediently also embodied as DT1 elements ($K_D=1$, $T=1_{34}/v$).

Because of the provisions of the invention, for decoupling the downstream web tension segments 45 and so forth, it is unnecessary to pilot-control the clamping point at printing unit 5 and so forth.

The foregoing relates to preferred exemplary embodiments of the invention, it being understood that other variants and embodiments thereof are possible within the spirit and scope of the invention, the latter being defined by the appended claims.

We claimed:

1. A method for web tension adjustment in a processing machine for processing a web of goods transported in a web transport direction, in particular in a shaftless printing press having an adjustable web tension in a first web tension segment disposed between a first clamping point and a second clamping point, the first web tension segment including a web tension and defining a center along the web transport direction, the first clamping point being located upstream of the center in the web transport direction and the second clamping point being located downstream of the center in the web transport direction, the method comprising the following steps:

delivering to the first clamping point a first control instruction, which is generated using a first dynamic element with a non-constant transmission function;

delivering to the second clamping point a second control instruction, which is generated using a second dynamic element with a non-constant transmission function; and selecting a control strategy from among one of a downstream strategy, if a downstream web tension is to be adjusted, and an upstream strategy, if an upstream web tension is to be adjusted;

wherein upon selection of the downstream strategy the first control instruction is generated form the second control instruction, the second control instruction being a master control instruction to adjust the second clamping point as a master clamping point and being based on the web tension of the first web tension segment, such that the first clamping point is pilot controlled by the second control instruction, or wherein upon selection of the upstream strategy the second control instruction is generated from the first control instruction, the first control instruction being the master control instruction to adjust the first clamping point as the master clamping point and being based on the web tension of the first web tension segment such that the second clamping point is pilot controlled by the first control instruction.

2. The method as defined by claim 1, wherein the non-constant transmission function includes a transmission function of a DT1 differential element, having a delay, or a PT1 proportional element, having a delay.

3. The method as defined by claim 2, wherein at least one third clamping point, located upstream in the web from the first clamping point, and to which is delivered a third control instruction generated by using a third dynamic element having a non-constant transmission function and from the second control instruction or from the controller output variable on which the second control instruction is based.

4. The method as defined by claim 2, wherein at least one third clamping point, located upstream in the web from the first clamping point, and to which is delivered a third control instruction generated by using a third dynamic element having a non-constant transmission function and from the first control instruction or from the controller output variable on which the second control instruction is based.

5. The method as defined by claim 2, in which the web tension in the first web tension segment is ascertained by means of metering elements, preferably pressure gauges, by means of driving torque of at least one clamping point defining that particular web tension segment, and/or by means of observers.

6. The method as defined by claim 1, wherein at least one third clamping point, located upstream in the web from the first clamping point, and to which is delivered a third control instruction generated by using a third dynamic element having a non-constant transmission function and from the second control instruction or from the controller output variable on which the second control instruction is based.

7. The method as defined by claim 1, wherein at least one third clamping point, located upstream in the web from the first clamping point, and to which is delivered a third control instruction generated by using a third dynamic element having a non-constant transmission function and from the first control instruction or from the controller output variable on which the second control instruction is based.

8. The method as defined by claim 1, in which the non-constant transmission function includes a transmission function of a PT1, PT2, PTn, DT1, DT2, DTn, IT1, ITn, and/or idle-time circuit.

9. The method as defined by claim 1, wherein a decoupling strategy is derived from addition and/or subtraction of dynamic and/or constant timing circuits.

10. The method as defined by claim 1, in which a decoupling strategy is derived from multiplication and/or division of dynamic and/or constant timing circuits.

11. The method as defined by claim 1, in which timing behavior of a dynamic element is determined in proportion to a web of goods length and/or inversely to the machine speed.

12. The method as defined by claim 1, in which the web tension in the first web tension segment is ascertained by means of metering elements, preferably pressure gauges, by means of driving torque of at least one clamping point defining that particular web tension segment, and/or by means of observers.

13. The method as defined by claim 1, wherein the web tension in the first web tension segment is adjusted by angular adjustment, speed imposition, and/or limitation of the driving torque of at least one clamping point defining the first web tension segment.

14. A computer program with program code means, for performing all the steps of a method as defined by claim 1, when the computer program is executed on a computer or a corresponding digital unit.

15. A computer program product with program code means which are stored in memory on a computer-readable data medium, for performing all the steps of a method as defined by claim 1, when the computer program is executed on a computer or a corresponding digital unit.

16. The method as defined by claim 1, further including a downstream clamping point located downstream along the web from the second clamping point, wherein the downstream clamping point is not a pilot controlled clamping point and does not receive the first control instruction generated from the second control instruction or from the controller output variable on which the second control instruction is based.

17. The method of claim 1 further comprising a web tension sensor disposed at the first web tension segment, the web tension sensor configured to determine the web tension of the first web tension segment.

18. A processing machine for processing a web of goods transported in a web transport direction, in particular a shaftless printing press, the processing machine having a digital unit, which is arranged for adjusting web tension in a first web tension segment defining a center along the web transport direction, a first clamping point located upstream from the center of the first web tension segment and a second web clamping point located downstream from in the center of the web tension segment, the digital unit generating a first control instruction using a first dynamic element with a non-constant transmission function and which is delivered to the first clamping point with the first control instruction, and the digital unit generating a second control instruction using a second dynamic element with a non-constant transmission function and which is delivered to the second clamping point with the second control instruction, the digital unit providing a selectable control strategy from among one of a downstream strategy, if a downstream web tension is to be adjusted, and an upstream strategy, if an upstream web tension is to be adjusted, wherein upon selection of the downstream strategy the first control instruction is generated form the second control instruction, which is identified as a master control instruction to adjust the second clamping point as a master clamping point and which is based on the web tension of the first web tension segment, or wherein upon selection of the upstream strategy the second control instruction is generated from the first control instruction, which is identified as the master control instruction to adjust the first clamping point as the master clamping point and which is based on the web tension of the first web tension segment.

* * * * *